US010132211B2

(12) United States Patent
Schmitt et al.

(10) Patent No.: US 10,132,211 B2
(45) Date of Patent: Nov. 20, 2018

(54) ROTOR FOR A CAMSHAFT ADJUSTER, PARTS SET FOR PRODUCING A ROTOR FOR A CAMSHAFT ADJUSTER AND METHOD FOR PRODUCING A JOINED COMPONENT, PREFERABLY A ROTOR FOR A CAMSHAFT ADJUSTER

(71) Applicants: GKN Sinter Metals Engineering GmbH, Radevormwald (DE); Schaeffler Technologies AG & Co. KG, Herzogenaurach (DE)

(72) Inventors: Rainer Schmitt, Wachtberg (DE); Antonio Casellas, Siegburg (DE); Kerstin Ziegler, Solingen (DE); Christian Bösel, Rednitzhembach (DE); Uwe Stollberger, Staffelbach (DE)

(73) Assignees: GKN Sinter Metals Engineering GmbH, Radevormwald (DE); Schaeffler Technologies AG & Co. KG, Herzogenaurach (DE)

( * ) Notice: Subject to any disclaimer, the term of this patent is extended or adjusted under 35 U.S.C. 154(b) by 177 days.

(21) Appl. No.: 15/023,813

(22) PCT Filed: Sep. 17, 2014

(86) PCT No.: PCT/EP2014/002512
§ 371 (c)(1),
(2) Date: Mar. 22, 2016

(87) PCT Pub. No.: WO2015/039745
PCT Pub. Date: Mar. 26, 2015

(65) Prior Publication Data

US 2016/0237861 A1 Aug. 18, 2016

(30) Foreign Application Priority Data

Sep. 23, 2013 (DE) ..... 10 2013 015 675

(51) Int. Cl.
*F01L 1/34* (2006.01)
*F01L 1/344* (2006.01)
(Continued)

(52) U.S. Cl.
CPC ..... *F01L 1/3442* (2013.01); *F02D 41/20* (2013.01); *F02D 41/2432* (2013.01);
(Continued)

(58) Field of Classification Search
CPC .... F01L 1/3442; F02D 41/20; F02D 41/2432; F02D 41/2464; F02D 2041/2058; H01F 7/18
See application file for complete search history.

(56) References Cited

U.S. PATENT DOCUMENTS 7,246,581 B2 * 7/2007 Suga ..... F01L 1/022 123/90.15
8,490,589 B2 7/2013 Arnold
(Continued)

FOREIGN PATENT DOCUMENTS

WO 2010/128976 A1 11/2010

OTHER PUBLICATIONS

PCT International Search Report for corresponding International Application No. PCT/EP2014/002512; dated May 28, 2015.

*Primary Examiner* — Thomas C Diaz
(74) *Attorney, Agent, or Firm* — Quarles & Brady LLP

(57) ABSTRACT

The invention relates to a rotor for a camshaft adjuster for rotation about a rotation axis. The rotor has an inner sheath and an outer sheath and at least one control vane, pointing at least substantially radially away from the rotation axis, having a first control vane side and a second control vane side. The rotor furthermore has a first liquid channel system and a second liquid channel system, wherein the first liquid channel system opens in a first liquid channel opening and
(Continued)

Figure 1:
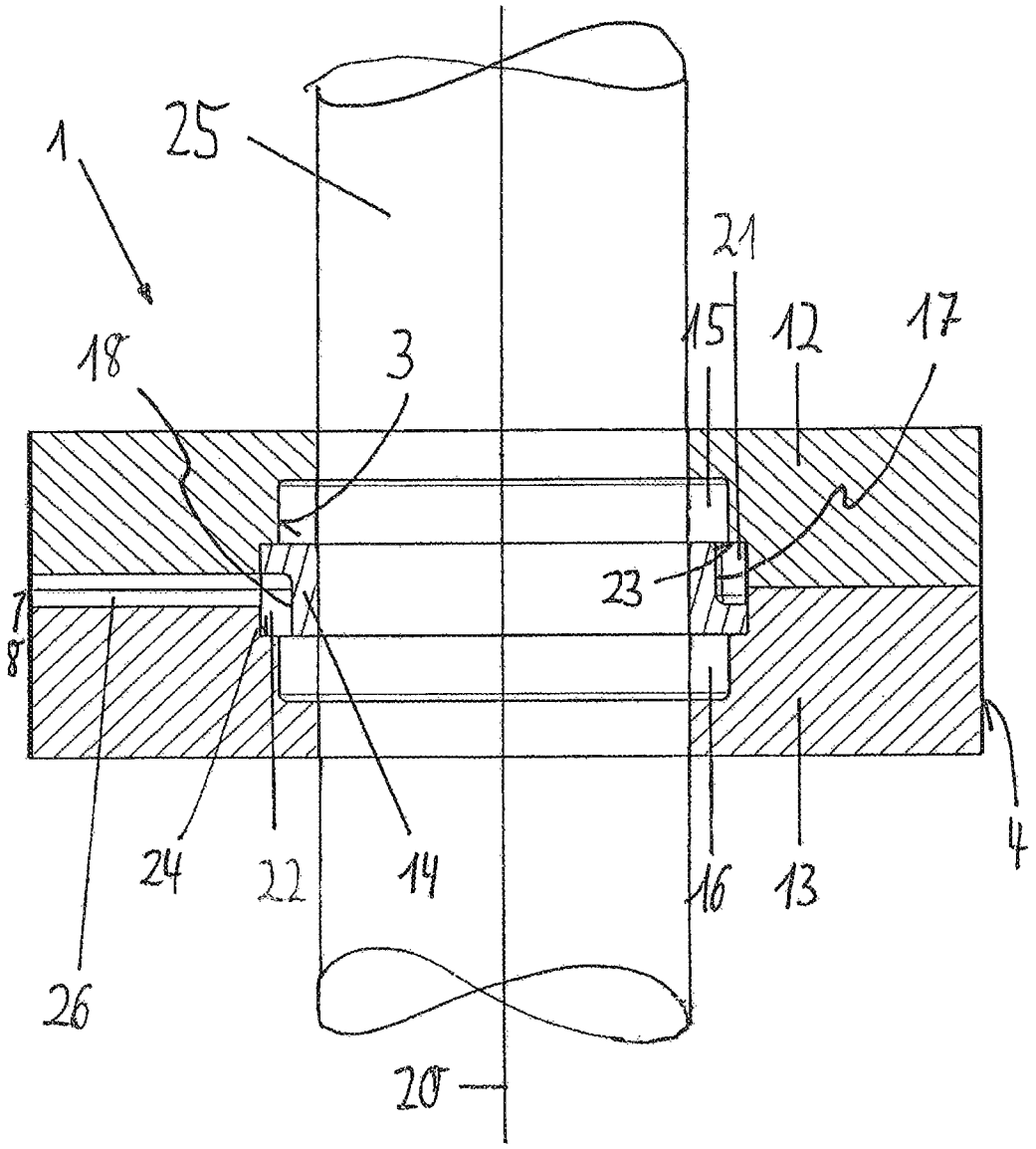

the second liquid channel system opens in a second liquid channel opening. The rotor comprises: a first sintered joining part, a second sintered joining part which is joined to the first sintered joining part and an insert part which is inserted in an intermediate chamber which is formed by at least one of a first recess of the first sintered joining part and a second recess of the second sintered joining part. The invention further relates to a parts set and to a method for producing a joined component.

7 Claims, 5 Drawing Sheets

(51) Int. Cl.
*F02D 41/20* (2006.01)
*F02D 41/24* (2006.01)
*H01F 7/18* (2006.01)

(52) U.S. Cl.
CPC ..... *F02D 41/2464* (2013.01); *H01F 7/18* (2013.01); *F02D 2041/2058* (2013.01)

(56) References Cited

U.S. PATENT DOCUMENTS

| | | | | |
|---|---|---|---|---|
| 8,550,046 | B2 | 10/2013 | Terfloth et al. | |
| 8,578,899 | B2 | 11/2013 | Ottersbach et al. | |
| 8,752,517 | B2 | 6/2014 | Boese et al. | |
| 9,284,862 | B2 | 3/2016 | Frey | |
| 2012/0060779 | A1* | 3/2012 | Adachi ..... | F01L 1/3442 123/90.15 |
| 2013/0199479 | A1 | 8/2013 | Ottersbach et al. | |

* cited by examiner

ROTOR FOR A CAMSHAFT ADJUSTER, PARTS SET FOR PRODUCING A ROTOR FOR A CAMSHAFT ADJUSTER AND METHOD FOR PRODUCING A JOINED COMPONENT, PREFERABLY A ROTOR FOR A CAMSHAFT ADJUSTER

This application represents the national stage entry of PCT International Application No. PCT/EP2014/002512 filed Sep. 17, 2014, which claims priority to German Patent Application No. 10 2013 015 675.0 filed Sep. 23, 2013, the disclosures of which are incorporated herein by reference in their entirety and for all purposes.

The present invention relates to a rotor for a camshaft adjuster for rotation about a rotational axis. Furthermore, the present invention relates to a parts set for producing a rotor for a camshaft adjuster. Moreover, the present invention relates to a method for producing a joined component, preferably a rotor for a camshaft adjuster.

One possible configuration of a camshaft adjuster for an internal combustion engine comprises a rotor and a stator which interacts with the rotor. In one refinement, the rotor can be connected to a camshaft of the internal combustion engine. The rotor has at least one, advantageously at least two, radially outwardly pointing control vanes, whereas the stator which surrounds the rotor has at least one stator pole which points in a radially and centrally inwardly oriented manner. Fluid chambers which are formed between the control vanes and the stator poles can be loaded with a pressure fluid by way of fluid duct systems of the rotor, the rotor assuming a first or a second circulating direction in the case of the chamber being loaded correspondingly with pressure, as a result of which the intended adjustment of the camshaft is brought about. The subject matter of the invention is a rotor for a camshaft adjuster, for example for a camshaft adjuster of the type mentioned at the outset.

One refinement of a multiple-part, joined rotor in hydraulic camshaft adjusters with join sealing profiles can be gathered from DE 10 2011 117 856 A1. In order to introduce fluid duct systems which run as advantageously as possible, a production of a rotor for a camshaft adjuster from two part bodies is proposed, each of the part bodies having, in its joining surface, open fluid duct parts which form fluid ducts during joining of the first part body to the second part body. In order to bring about a sealing action of the fluid ducts and therefore of the entire rotor with respect to the surroundings to such an extent that the fluid ducts remain sealed with respect to the pressure fluids which run in them, the joining surface has at least one sealing means which is configured in such a way that the fluid ducts are sealed. As a result, a defined contact of the joining surfaces which are moved onto one another is to be provided and a separation of the various fluid ducts within the rotor from one another and the fluid duct systems with respect to an external one is to be brought about. Here, the sealing means can be configured, for example, as elevations.

A production of a rotor for a camshaft adjuster from two part bodies, for example in accordance with the way which is described in DE 10 2011 117 856 A1, is advantageous for making it possible to introduce ducts for a pressure fluid which have complex courses and the complexity of which would be limited in the case of merely material-removing machining of a single-part rotor. Even in the case of the two-part refinement of the rotor, however, the routing of the fluids is restricted to courses which are such that they can be produced in a joining surface. As a consequence, the positioning of the camshaft adjusting device within an engine and, as a result, also positioning of the camshaft are also, in particular, subject to restrictions.

The invention is therefore based on the object of providing a rotor for a camshaft adjuster, which rotor has improved possibilities for the course of the routing of a pressure fluid.

The object is achieved by way of a rotor for a camshaft adjuster having the features of claim 1, by way of a parts set for producing a rotor for a camshaft adjuster having the features of claim 5, and by way of a method for producing a joined component, preferably a rotor for a camshaft adjuster. Further advantageous refinements and developments are apparent from the following description. One or more features from the claims, the description and the figures can be linked with one or more features therefrom to form further refinements of the invention. In particular, one or more features from the independent claims can also be replaced by one or more other features from the description and/or the figures. The proposed claims are to be understood to be merely a draft for wording the subject matter, without being restricted to this, however.

A rotor for a camshaft adjuster for rotation about a rotational axis is provided. The rotor has an inner shell, an outer shell, at least one control vane which points at least substantially radially away from the outer shell, and at least a first fluid duct system and a second fluid duct system. The first fluid duct system opens into a first fluid duct opening. The second fluid duct system opens into a second fluid duct opening. The first fluid duct system opens into the first fluid duct opening and the second fluid duct system opens into the second fluid duct opening for the adjustable pressure loading of the first control vane side and the second control vane side by means of one or more pressure fluids which are conducted through the first fluid duct system and the second fluid duct system. The first fluid duct opening preferably faces a first control vane side of the at least one control vane. The second fluid duct opening likewise preferably faces a second control vane side of the at least one control vane.

The rotor comprises:

- a first sinter-joined part,
- a second sinter-joined part which is joined to the first sinter-joined part, and
- an insert part which is inserted into an intermediate space. The intermediate space is formed by at least one of a first recess of the first sinter-joined part and a second recess of the second sinter-joined part.

The term rotor refers to the fact that the rotor is a component which is provided for a rotational movement about a rotational axis. Here, a rotational movement even by only a few degrees can be sufficient. It can be provided, for example, that the rotor is a rotationally symmetrical or a substantially rotationally symmetrical component. However, it can also be provided in another refinement that it is a non-rotationally symmetrical component; in this case, the term rotational axis refers merely to that axis about which a rotational movement is provided. The term rotational axis therefore does not necessarily imply a required rotational symmetry, but rather refers merely to the fact that the rotor is provided for a rotation.

The terms first fluid duct system and second fluid duct system refer to the fact that a fluid duct system is an entirety of ducts which run from a region of the inner shell toward an opening. It can be provided, for example, that the first fluid duct system runs from the inner shell to the outer shell. Here, the first fluid duct system is to open into the first fluid duct opening. A fluid duct system can consist, for example, of one fluid duct, but it can also be provided, for example, that a fluid duct system can have a plurality of fluid ducts or other geometries which conduct a fluid, such as grooves, undercuts or the like, which merge into one another.

The control vane is a vane which points substantially radially from the rotational axis. Here, the explanation of the orientation which points substantially radially away from the rotational axis refers to the fact that the control vane can have, for example, an axis of symmetry which intersects the rotational axis.

In one specific refinement, the control vane has an axis of symmetry which contains the rotational axis. This results in the advantage of great rotational symmetry, which results in particular suitability for a rotor which is provided for rotation.

However, deviations from a symmetrical refinement, for example by way of a beveled configuration of one or more control vane sides or, for example, an angled-away portion of the control vane in a course which points away from the rotational axis, can also be provided. A construction of this type ensures the method of operation that a rotation of the rotor about its rotational axis is brought about by means of a pressure which is generated by way of a pressure fluid, and the rotational direction is changed depending on the selected control vane side.

For the principal function of the rotor for a camshaft adjuster, a presence of one control vane can in principle be sufficient depending on the construction of the camshaft adjuster.

In one preferred refinement, however, the rotor has more than one control vane. In a particularly preferred refinement, the control vane has at least three control vanes.

In one particularly preferred refinement, the control vanes are arranged in a uniform angular distribution, with the result that, for example, in the case of a presence of N control vanes, two adjacent control vanes would be brought into congruence by way of a rotation of the rotor by 360/N degrees, N being an integer which is at least 2.

In order to understand the refinement explained at the outset, a fluid duct opening points in such cases toward a first control vane side of the at least one control vane, if the first control vane side is the next surface which belongs to a control vane.

The term sinter-joined part refers, in particular, to the fact that the sinter-joined part is a component which has already been subjected to a sintering process. It is preferably provided that no further sintering of the sinter-joined part is required. In other refinements, however, it can be provided, for example, that one further sintering operation of the sintered part is provided and/or required. Further heat treatments can likewise be provided and/or required.

The term sinter-joined part comprises, moreover, that the component is provided for joining to form a sintered part by means of joining to at least one further sinter-joined part.

Here, a sinter-joined part can have, for example, a sintering metal, a sintering steel and/or a sintering ceramic.

In one preferred refinement, the insert part can be a sintered part. The refinement of the insert part as a sintered part results, in particular, in the advantage that high flexibility in the configuration of the insert part is possible and material-removing machining is not necessarily required.

However, it can also be provided in another refinement, for example, that the insert part is not a sintered part, but rather is different than a sintered part, for example a cast component or a component which is produced by means of material-removing machining, for example made from a metal, a metal alloy or a ceramic. A configuration of the insert part made from a plastic can likewise be provided, for example.

The insert part is inserted into an intermediate space which is formed by at least one first recess of the first sinter-joined part and a second recess of the second sinter-joined part. Here, it can be provided, for example, that the first sinter-joined part has a recess, and that the second sinter-joined part has a recess, an intermediate space being formed from the first recess and the second recess in the joined state of the rotor. Here, it can be provided, for example, that the insert part fills the intermediate space at least partially. It can likewise be provided, for example, that the intermediate space is completely filled. Here, the term recess relates to the fact that, for example, a depression can be configured in at least one of the sinter-joined parts. However, the term recess can also denote, for example, a continuous recess, for example a hole which is continuous through the sinter-joined part. In a case of this type, the term inserting the insert part into the intermediate space would refer, in particular, to the fact that the insert part is encompassed at least partially by the first sinter-joined part and at least partially by the second sinter-joined part and, in particular, is also enclosed by the first sinter-joined part and/or the second sinter-joined part but is not necessarily enclosed completely by said first sinter-joined part and the second sinter-joined part.

It can be provided that the first sinter-joined part, the second sinter-joined part and/or the insert part are joined to one another in a non-positive manner, positively locking manner, frictionally locking manner or in some other way.

In one advantageous refinement of the rotor, for example, it can be provided that the first sinter-joined part has a first axial depression which is configured as a first groove which runs around the rotational axis at least partially. The first groove is connected via a first radial duct to the first fluid duct opening. The first groove and/or the first radial duct therefore form/forms at least one part of the first fluid duct system. The first groove acts as a first pressure fluid distributor. The fact that the first axial depression is configured as a first groove which runs around the rotational axis at least partially results in the advantage that the pressure fluid can be distributed in a manner which runs around the rotational axis, and a distribution of the pressure fluid can take place during the circulation of the first groove, in order that the first groove is configured as a pressure fluid distributor. The configuration of the pressure fluid distributor as a groove which runs around the rotational axis at least partially, preferably as a groove which runs around the rotational axis completely, results in the advantage that the pressure fluid can be distributed to various positions of the circulation of the rotational axis. This results, as a consequence, in greater flexibility in positioning the rotor and therefore in positioning the camshaft adjuster within the engine.

In one preferred refinement of the rotor, the first axial depression is configured as a first groove which preferably runs around the rotational axis completely.

The term depression refers here to the fact that the depression is a recess which is situated within the first sinter-joined part. It can be provided, for example, that it is an axial depression which is situated in a region which transcends the extent of the insert part in the axial direction within the first sinter-joined part.

It can likewise be provided that the second sinter-joined part has a second axial depression which is configured as a second groove which runs around the rotational axis at least partially, preferably completely. The second axial depression is connected via a second radial duct to the second fluid duct opening. The second axial depression forms, as second pressure fluid distributor, at least one part of the second fluid duct system.

The term radial duct denotes a duct which runs from the interior of the rotor toward a fluid duct opening which is situated on the outer shell of the rotor. The radial duct therefore has at least one radial component. Here, the radial duct can be a duct which runs along a radial direction and can be configured, for example, as a bore. However, it can likewise also be provided that the radial duct has directional components which differ from said radial direction. It can thus be provided, for example, that the radial duct is configured in a meandering course.

In a further refinement of the rotor, it can be provided, for example, that, in its radial extent, the insert part separates the first axial depression in the axial direction completely from the second axial depression in order to separate the first fluid duct system from the second fluid duct system. In its radial extent, at each point of its circulation at at least one location of its axial extent, the insert part therefore has a flush or at least substantially flush termination with one or more of

- the first sinter-joined part and/or the second sinter-joined part,
- a further component which is situated between the insert part and the first sinter-joined part and/or the second sinter-joined part.

The flush termination between the insert part and one or more of the sinter-joined parts and/or a further component which is situated between the insert part and the first sinter-joined part and/or the second sinter-joined part has the effect that no connection is established between the first axial depression and the second axial depression in an axial direction of the insert part for a pressure fluid which is situated in the first fluid duct system and/or the second fluid duct system. Here, a separation of this type of the first axial depression from the second axial depression by way of structural facilitation of flush positioning of the insert part with the first sinter-joined part and/or the second sinter-joined part contributes to a separation of the first fluid duct system from the second fluid duct system. This results in the advantage that two fluid duct systems which are separate from one another are present within the rotor, with the result that in each case one fluid duct system is provided for conducting the pressure fluid for two desired rotational directions.

In a further advantageous refinement, it can be provided, for example, that the insert part has at least one first undercut in its radial extent. From a first end of the axial extent of the insert part, the first undercut assumes a part region of the axial extent of the insert part. Furthermore, the insert part has at least one second undercut in its radial extent. Starting from the end of the axial extent of the insert part which is situated opposite the first end of the insert part, the second undercut assumes a part region of the axial extent of the insert part. The first undercut runs around the rotational axis partially. The second undercut likewise runs around the rotational axis partially. The first undercut and the second undercut are arranged in an alternating manner, as a result of which it is brought about that a connection of the first axial depression and a connection of the second axial depression in each case to a radial duct takes place.

As an aim of the alternating connection of the first axial depression and the second axial depression by means of undercuts which are configured on the insert part in an alternating manner, that is to say, for example, by means of the alternating arrangement of the first undercut and the second undercut, the first axial depression is connected by means of the first undercut to the first radial duct in order to form the first fluid duct system, and the second undercut is connected to the second axial depression by way of at least the second radial duct in order to form the second fluid duct system. The connection of the first undercut with the first of the first undercut to the first axial depression and the first radial duct and the connection of the second undercut to the second axial depression and the second radial duct are arranged in an alternating manner.

Furthermore, it can be provided that a number of more than two undercuts are configured on the insert part. In one particularly preferred refinement, it can thus be provided, for example, that a number of undercuts corresponds to twice the number of control vanes. A number of undercuts which corresponds to twice the number of control vanes has the advantage as a consequence, in particular, that in each case the first control vane side and the second control vane side can be loaded with a pressure fluid for each of the existing control vanes. For this purpose, for a first control vane of the rotor, the first control vane side can be pressure-loaded with a first pressure fluid starting from the first undercut and the second side can be loaded with a second pressure fluid starting from the second undercut. Further control vanes of the rotor can be pressure-loaded via undercuts which are made in an alternating manner in the circulation of the insert part in each case on one control vane side with the first pressure fluid and on another control vane side with the second pressure fluid.

A further concept of the invention which can be pursued further independently and also in combination with the other concepts of the invention relates to a parts set for producing a rotor for a camshaft adjuster.

Here, this is a parts set for producing a rotor for a camshaft adjuster, the rotor having at least a first fluid duct system and a second fluid duct system. The first fluid duct system and the second fluid duct system have fluid routing systems which are configured separately from one another. The parts set comprises at least:

- a first sinter-joined part,
- a second sinter-joined part,
- an insert part for insertion into a recess, the recess being formed at least by a first recess of the first sinter-joined part and/or a second recess of the second sinter-joined part.

Here, the fluid routing systems which are present separately from one another of the first fluid duct system and the second fluid duct system are to be understood in such a way that there is a separately present fluid conducting system in the camshaft adjuster in the assembled state. It can thus be provided, for example, that a fluid duct system has a first groove and a second groove such that they are made in the insert part, the first groove and the second groove being separated from one another only after the rotor is applied to the camshaft. A case of this type is included according to the understanding present here of the terminology of the fluid routing systems which are present separately from one another.

In one preferred refinement of the parts set, it can be provided, for example, that the first recess and/or the second recess are/is of cylindrical configuration at least over a region of their/its axial extent. In one preferred refinement, it can be provided that the first recess and/or the second recess are/is of circularly cylindrical configuration at least over a region of their/its axial extent. A refinement of the first recess and/or the second recess as recesses of circularly cylindrical configuration also has advantages in terms of production, in particular.

In a further refinement of the parts set, it can be provided, for example, that, at least over a region of the axial extent of the first sinter-joined part, a radial extent of the first recess corresponds to a radial extent of the insert part at least substantially over a first axial section. This causes at least substantially flush introduction of the insert part into the first recess to be brought about.

This causes at least substantially flush introduction of the insert part into the second recess to be brought about. The terms radial extent over a first axial section and radial extent over a second axial section are to be understood here in such a way that the entire radial extent of the entire recess is terminated flush by means of the insert part at each position of the outer shell of the insert part at least on a region of the axial section, with the result that a separation of the first recess from the second recess takes place in an axial direction after joining of the first sinter-joined part and the second sinter-joined part to the insert part and, as a result, two fluid duct systems which are present independently of one another can be made possible by way of the separation of the first axial depression and the second axial depression from one another.

In a further refinement of the parts set, it can be provided, for example, that the first recess has a first radial face which is configured as a first seat face for a region of a first end side of the insert part. After positioning of the insert part on the first seat face, the region of the first end side of the insert part is adjacent to a first axial depression of the first sinter-joined part.

It can also be provided in another refinement, for example, that the second recess has a second radial face which is configured as a second seat face for a region of a second end side of the insert part. After positioning of the insert part on the second seat face, the region of the second end side of the insert part is adjacent to the second axial depression of the second sinter-joined part.

Here, the term seat face refers to a face which is configured, for example, as a region with an at least partially lower radial recess than the radial extent of the first recess and the insert part. Here, the first seat face and/or the second seat face can preferably be situated in a parallel plane of an end side of the first sinter-joined part and/or can be present in a parallel plane of an end side of the second sinter-joined part. In particular in the case of the insert part being formed with an at least substantially cylindrical configuration, the advantage arises that there is parallel positioning of the end sides of the rotor and the end sides of the insert part, as a result of which a structural implementation of the parts set which is optimized in terms of outlay is achieved.

A spacing of the first seat face from the second seat face in the joined state of the first sinter-joined part and the second sinter-joined part to form a rotor preferably corresponds to an axial extent of the insert part. This results in the advantage that axial positioning of the insert part within the recess is simplified considerably.

However, it can likewise be provided that a spacing of the first seat face from the second seat face is greater than an axial extent of the insert part, it being possible for an axial extent of the insert part to be brought about, for example, by way of correspondingly additionally introduced spacer elements or, for example, by way of a press fit and/or frictional fit of the insert part being brought about within a recess of the first sinter-joined part and/or the second sinter-joined part.

In a further refinement of the parts set, it can be provided, for example, that, in its radial extent, the insert part has at least one first radial recess which is configured as a first undercut. As a result, a first fluid space is formed at least in regions, which first fluid space is arranged so as to adjoin the first axial depression at least in regions.

Furthermore, it can be provided, for example, that, in its radial extent, the insert part has at least one second radial recess which is configured as a second undercut in order to form a second fluid space which is arranged so as to adjoin the second axial depression at least in regions.

In a further refinement of the parts set, it can be provided, for example, that the insert part has an axial web between the radial recesses, for the at least substantially flush termination with an inner shell of the first sinter-joined part and/or with an inner shell of the second sinter-joined part in order to separate the first fluid space from the second fluid space. Here, the term axial web denotes a region of the insert part which, in the joined state of the rotor, is positioned at least substantially flush with the inner shell of the first and/or with the inner shell of the second and has at least one directional component here which is parallel to the rotational axis of the rotor at least in regions, with the result that, at least along a region of the axial web, it runs in a direction from a first end side of the insert part toward a second end side of the insert part.

Here, an axial extent of the axial web is to correspond at least to an axial spacing of the first undercut and the second undercut in order to make the separation of the first undercut from the second undercut possible. By way of the axial web in interaction with the inner shell of the first sinter-joined part and/or in interaction with the inner shell of the second sinter-joined part, the space which is formed by the first undercut is separated from the space which is formed by the second undercut, with the result that a leakage between the two spaces is not present or is present to a sufficiently low extent.

A further refinement of the parts set can provide, for example, that the first sinter-joined part has at least one first radial duct in order to form the first fluid duct system by means of a connection of the first fluid space to the outer shell. Furthermore, a refinement of a parts set can be provided, for example, in which the second sinter-joined part has at least one second radial duct in order to form the first fluid duct system by means of a connection of the second fluid space to the outer shell.

In a further advantageous refinement of the parts set, it can be provided, for example, that the first sinter-joined part and the second sinter-joined part have an identical shape. A refinement of the first sinter-joined part and the second sinter-joined part with an identical shape has the advantage, in particular, that the outlay in terms of production technology for producing the parts set is reduced, since the number of different components is reduced.

Another concept of the invention which can be pursued further independently and also in combination with the other concepts of the invention relates to a method for producing a joined component. Said concept preferably relates to a method for producing a joined component which is configured as a rotor for a camshaft adjuster.

The component which is joined by means of the method has at least a first fluid duct system and a second fluid duct system. The first fluid duct system and the second fluid duct system have a fluid routing system which is present separately from one another.

The joining of the sintered component comprises at least:

insertion of at least one insert part into a first recess of a first sinter-joined part, joining of the sinter-joined parts, joining of the insert part to at least one of the first sinter-joined part and the second sinter-joined part.

The first recess of the first sinter-joined part is preferably of cylindrical configuration at least over a region of its axial extent.

The insert part is likewise preferably inserted into a second recess of a second sinter-joined part by way of the joining of the sinter-joined parts.

The joining of the insert part can take place by the insert part being joined to the first sinter-joined part, the second sinter-joined part, the first and the second sinter-joined part and/or to further components, for example in a non-positive manner, frictionally locking manner, positively locking manner and/or in a press fit.

In a specific refinement of the method, it can be provided, for example, that a radial final dimension of the insert part is brought about by way of joining of the insert part, by means of a pressure which acts on the insert part, which pressure is brought about by way of at least one of the first sinter-joined part and the second sinter-joined part. Here, the radial final dimension of the insert part can be brought about in direct contact of the first sinter-joined part and/or the second sinter-joined part on the insert part. However, it can likewise also be provided that a further component is arranged between the insert part and the first sinter-joined part and/or the second sinter-joined part.

In a further refinement of the method, it can be provided, for example, that an axial final dimension of the insert part is brought about by means of a pressure which acts on the insert part, which pressure is brought about at least by way of the first sinter-joined part and/or the second sinter-joined part.

Here, bringing about a radial final dimension and/or an axial final dimension of the insert part by way of the joining has the advantage, in particular, as a result that bringing about a final dimension of the insert part does not have to take place into the first sinter-joined part and/or the second sinter-joined part, with the result that the number of production steps to be performed is reduced. A further advantage which arises by way of bringing about a final dimension of the insert part by way of pressure which is brought about by way of the first sinter-joined part and/or the second sinter-joined part is the possibility brought about as a result of a greater tolerance of the insert parts which are produced, with the result that the outlay which is to be applied for the production of the insert parts can be reduced further.

It can be provided that a parts set is used, in order to join a rotor for a camshaft adjuster. The use of a parts set is to be provided, in particular, for joining to a rotor with at least two fluid duct systems which are separate from one another.

Further advantageous refinements and developments are apparent from the following figures. However, the details and features which are apparent from the figures are not restricted thereto. Rather, one or more features can be linked to one or more features from the above description to form new refinements. In particular, the following explanations do not serve as a restriction of the respective scope of protection, but rather explain individual features and their possible interaction among one another.

Figure 2:
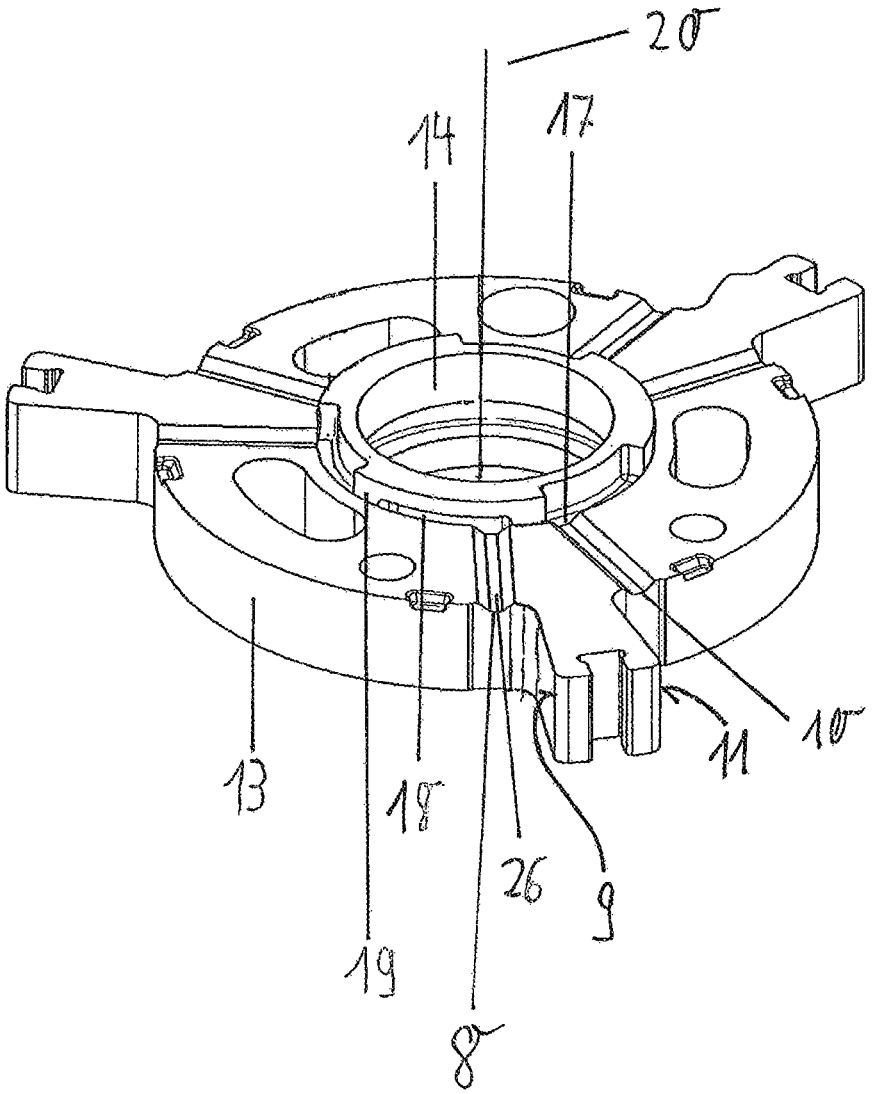
Figure 3:
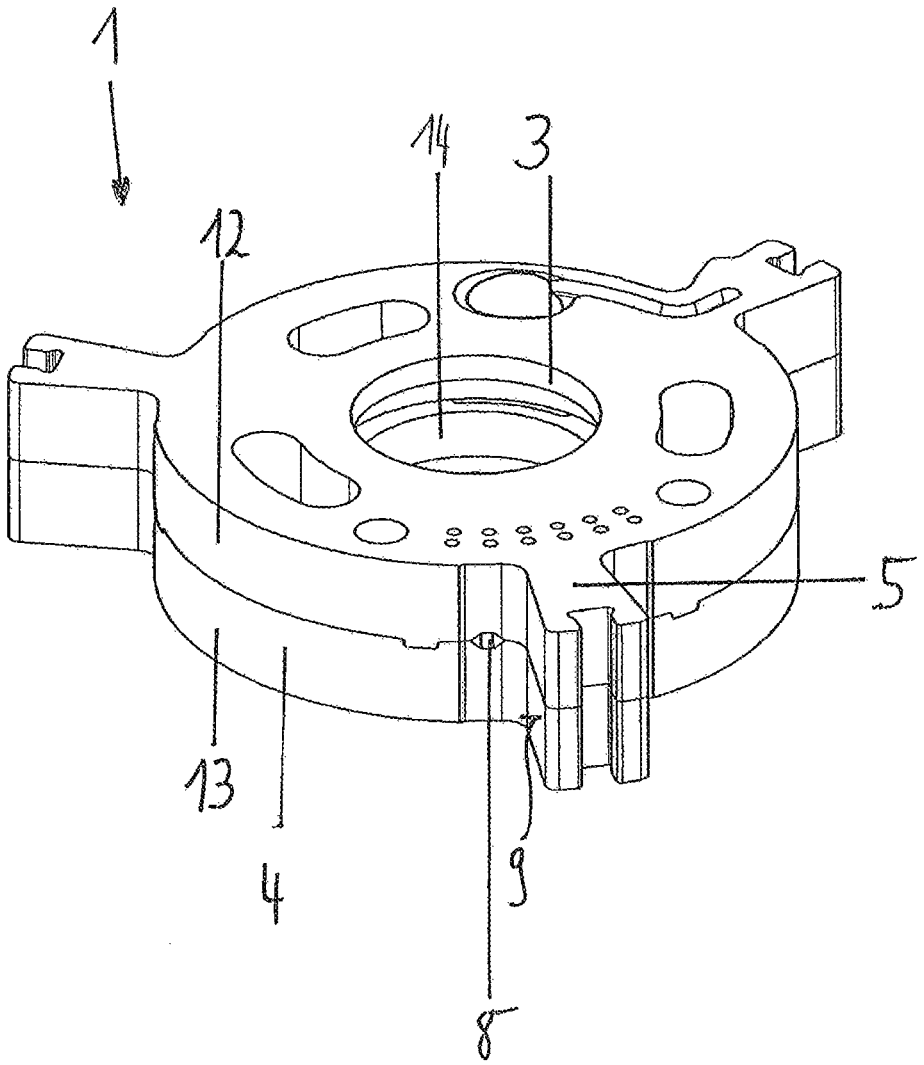
Figure 4:
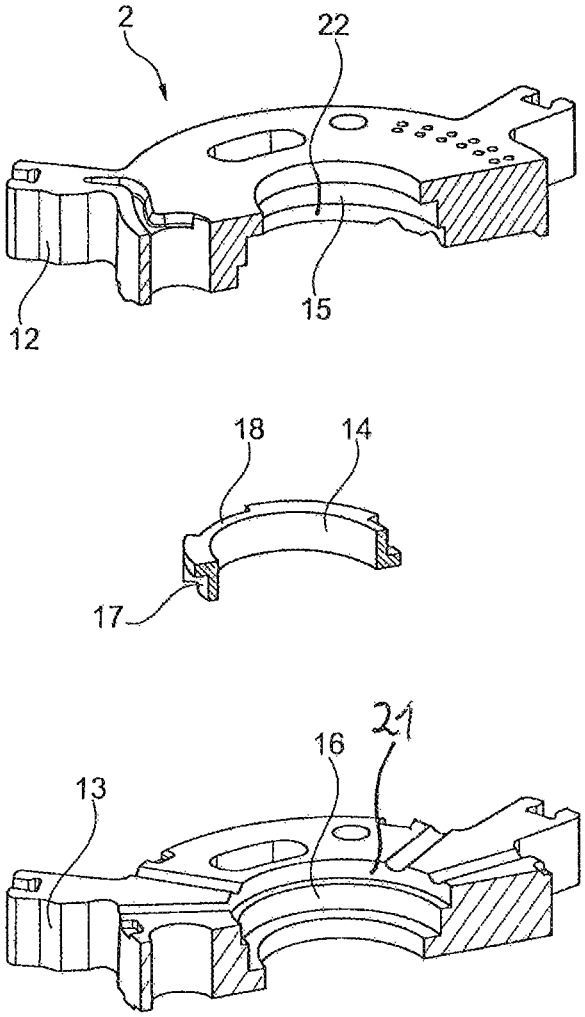
Figure 5:
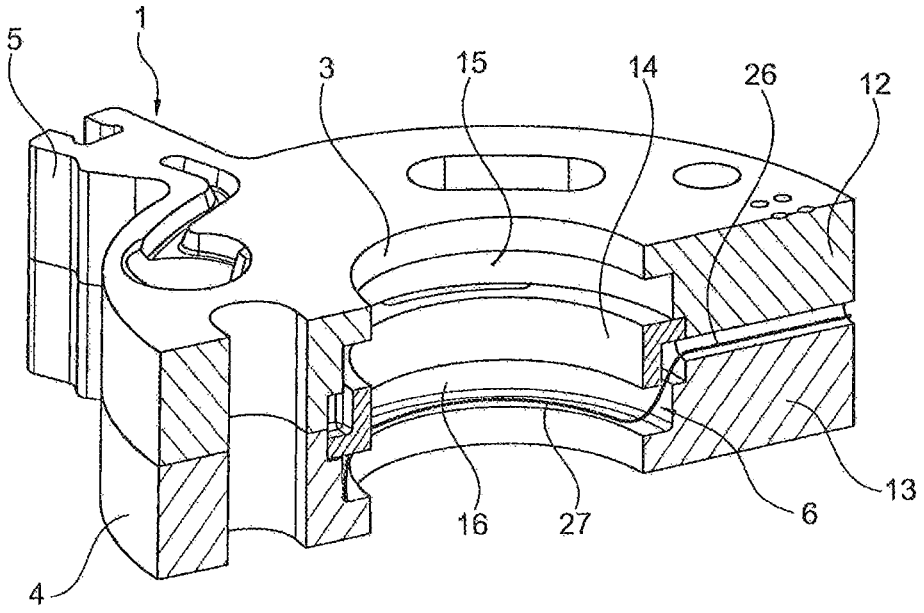

In the figures:

FIG. 1 shows an illustration of an exemplary refinement of a rotor for a camshaft adjuster in section, FIG. 2 shows a further exemplary illustration of a sinter-joined part with an inserted insert part, FIG. 3 shows a further exemplary illustration of a rotor for a camshaft adjuster in an oblique view, FIG. 4 shows a further exemplary illustration of a rotor for a camshaft adjuster in an exploded illustration, and FIG. 5 shows a further exemplary illustration of a section of a rotor of a camshaft adjuster in an oblique illustration.

A refinement of a rotor 1 for a camshaft adjuster in cross section can be gathered from FIG. 1. Here, the rotor 1 has a first sinter-joined part 12 and a second sinter-joined part 13 which are joined to one another. The first sinter-joined part 12 has a first recess 21, and the second sinter-joined part 13 has a second recess 22, the first recess 21 having a first seat face 23 and the second recess 22 having a second seat face 24 for the insert part 14. The insert part 14 is inserted in an intermediate space which is formed by the first recess 21 and the second recess 22.

Starting from the first recess 21, the rotor 1 has a first axial depression 15 in the region of the first sinter-joined part 12, the first axial depression 15 being configured as a completely circumferential groove after the rotor 1 is placed onto the camshaft 25. The insert part 14 has a first undercut 17 which, in its radial indentation, protrudes beyond the radial extent of the first seat face 23 of the insert part 14 on the first sinter-joined part 12 and, as a result, forms a connection of the space which is formed by the first undercut 17 to the first axial depression 15. The first completely circumferential groove, as which the first axial depression 15 is configured, acts as a first pressure fluid distributor as a result. Furthermore, the insert part 14 has a second undercut 18 which, in its radial indentation, protrudes beyond the radial extent of the second seat face 24 of the insert part on the second sinter-joined part 13 and, as a result, establishes a connection of the second axial depression 16 which is configured as a second completely circumferential groove to the space which is formed by way of the second undercut 18. As can likewise be gathered from FIG. 1, a connection from the second axial depression 16 via the second undercut 18 toward the first fluid duct opening 8 is brought about by the radial duct 26. In addition to the first undercut 17 which is depicted and the second undercut 18 which is likewise to be gathered from FIG. 1, the insert part 14 has further undercuts, a first half of the undercuts having their opening in a manner which in each case faces the first sinter-joined part 12 and a second half of the undercuts having in a manner which in each case faces the second sinter-joined part 13 in the refinement of the rotor which can be gathered from FIG. 1. The undercuts are oriented in an alternating manner about the rotational axis 20 in a circulation of the insert part 14.

A refinement of the second sinter-joined part 13 with the insert part 14 which is introduced into the second recess of the second sinter-joined part 13 can be gathered from FIG. 2. Furthermore, a first undercut 17 can be gathered from FIG. 2, which first undercut 17 is oriented with its opening so as to face the first sinter-joined part; the first sinter-joined part cannot be gathered from FIG. 2. As a result, a connection from the first axial depression via the first undercut toward the second fluid duct opening 10 is brought about. Furthermore, the second undercut 18 can be gathered from FIG. 2, which second undercut 18 establishes a connection between a second axial depression of the second sinter-joined part 13 and, via the radial duct 26, a first fluid duct opening 8. Furthermore, it can be gathered from FIG. 2 that undercuts which face the first sinter-joined part 12 are arranged with undercuts which face the second sinter-joined part so as to alternate in terms of the orientation of the opening in the circulation of the insert part 14 about the rotational axis 20. As a result, a first fluid duct opening 8 which faces the first control vane side 9 is connected to a second axial depression and a second fluid duct opening 10 which faces the second control vane side 11 is connected to a first axial depression 16, in each case in an alternating manner for each control vane, with the result that two different rotational directions of the rotor are made possible by means of pressure loading with a pressure fluid, each of the two rotational directions corresponding in each case to pressure loading via one of the two axial depressions. In the exemplary refinement which is shown, both axial depressions are provided as completely circumferential grooves. A radial distribution of the corresponding pressure fluid to the respectively provided control vane side of the control vanes takes place, as described above, via the undercuts which are connected in each case to one of the two grooves.

A rotor 1 which is similar to the rotor 1 from FIG. 2 can be gathered from FIG. 3, FIG. 3 having had the first sinter-joined part 12 added to it in comparison with FIG. 2. As a result, the first fluid duct opening 8 can then be gathered from FIG. 3 in a complete way, which fluid duct opening 8 is oriented so as to face the first control vane side 9 of the control vane 5. The insert part 14 can be gathered from FIG. 3 merely in the inner recess of the rotor 1 which is provided for the introduction of the camshaft, in order to completely form the first groove from the first axial depression 15 and the second groove from the second axial depression 16.

The rotor from FIG. 3 can be gathered from FIG. 4 in an exploded illustration as a parts set 2.

The rotor 1 in a joined state in section in an oblique illustration can be gathered from FIG. 5. In the sectional illustration of FIG. 5, furthermore, the solid line 27 denotes the course of the first fluid duct system 6, having the second axial depression 16 which is configured as a second groove and, inter alia, the radial duct 26 toward the second fluid duct opening 8.

The invention claimed is:

1. A rotor for a camshaft adjuster for rotation about a rotational axis, the rotor comprising:

an inner shell;

an outer shell;

at least one control vane which points at least substantially radially away from the rotational axis; and at least a first fluid duct system and a second fluid duct system, the first fluid duct system opening into the outer shell in a first fluid duct opening and the second fluid duct system opening into the outer shell in a second fluid duct opening for the adjustable pressure loading of a first control vane side and a second control vane side of the at least one control vane by one or more pressure fluids which are conducted through the first fluid duct system and the second fluid duct system;

wherein the rotor further comprises a first sinter-joined part, a second sinter-joined part which is joined to the first sinter-joined part, and an insert part which is inserted into an intermediate space which is formed by at least one of a first recess of the first sinter-joined part and a second recess of the second sinter-joined part;

wherein the first recess is a first axial depression and the second recess is a second axial depression and wherein, in its radial extent, the insert part separates the first axial depression in the axial direction completely from the second axial depression in order to separate the first fluid duct system from the second fluid duct system.

2. The rotor as claimed in claim 1, wherein the first axial depression is configured as a first groove which runs around the rotational axis at least partially, is connected via a first radial duct to the first fluid duct opening, and, as first pressure fluid distributor, forms at least one part of the first fluid duct system, and/or wherein the second axial depression is configured as a second groove which runs around the rotational axis at least partially, is connected via a second radial duct to the second fluid duct opening, and, as second pressure fluid distributor, forms at least one part of the second fluid duct system.

3. The rotor as claimed in claim 2, wherein the insert part has at least one first undercut in its radial extent which, starting from a first end of the axial extent of the insert part, assumes a part region of the axial extent of the insert part, and in that the insert part has at least one second undercut in its radial extent, which second undercut, starting from the opposite end of the axial extent of the insert part to the first end, assumes a part region of the axial extent of the insert part, the first undercut and the second undercut in each case running partially around the rotational axis and being arranged in an alternating manner here for the alternating connection of the first axial depression to at least the first radial duct in order to form the first fluid duct system and the second axial depression to at least the second radial duct in order to form the second fluid duct system.

4. The rotor as claimed in claim 1, wherein the first fluid duct opening faces a first control vane side of the at least one control vane and the second fluid duct opening faces a second control vane side of the at least one control vane.

5. A method for producing a rotor for a camshaft adjuster for rotation about a rotational axis in which the rotor includes an inner shell, an outer shell, and at least one control vane which points at least substantially radially away from the rotational axis and in which the rotor has at least a first fluid duct system and a second fluid duct system, the first fluid duct system opening into the outer shell in a first fluid duct opening and the second fluid duct system opening into the outer shell in a second fluid duct opening for the adjustable pressure loading of a first control vane side and a second control vane side of the at least one control vane by one or more pressure fluids which are conducted through the first fluid duct system and the second fluid duct system, and the joining of the sintered component comprises:

inserting of at least one insert part into an intermediate space which is formed by at least one of a first recess of a first sinter-joined part and a second recess of a second sinter-joined part, joining of the first sinter-joined part and the second sinter-joined part, joining of the insert part to at least one of the first sinter-joined part and the second sinter-joined part;

wherein the first recess is a first axial depression and the second recess is a second axial depression and wherein, in its radial extent, the insert part separates the first axial depression in the axial direction completely from the second axial depression in order to separate the first fluid duct system from the second fluid duct system.

6. The method as claimed in claim 5, wherein a radial final dimension of the insert part and/or an axial final dimension of the insert part are/is brought about by way of the joining of the insert part, by pressure which acts on the insert part by way of at least one of the first sinter-joined part and the second sinter-joined part.

7. The method as claimed in claim 5, wherein the first recess is cylindrical over a region of the axial extent, and wherein the insert part is joined to both of the first sinter-joined part and the second sinter-joined part.

* * * * *